US011112122B2

(12) United States Patent
Blommaert et al.

(10) Patent No.: US 11,112,122 B2
(45) Date of Patent: Sep. 7, 2021

(54) SYSTEM COMPRISING A SELF-CLEANING OVEN, AND METHOD FOR CLEANING A SELF-CLEANING OVEN

(71) Applicant: Fri-Jado B.V., Oud Gastel (NL)

(72) Inventors: Martinus Blommaert, Etten-Laur (NL); Robert Evert Willem Berents, Berkel-Enschot (NL); Petrus Baptist Catharina Koolen, Bergen op Zoom (NL)

(73) Assignee: Fri-Jado B.V., Oud Gastel (NL)

( * ) Notice: Subject to any disclaimer, the term of this patent is extended or adjusted under 35 U.S.C. 154(b) by 44 days.

(21) Appl. No.: 16/328,740

(22) PCT Filed: Sep. 1, 2017

(86) PCT No.: PCT/NL2017/050579
§ 371 (c)(1),
(2) Date: Feb. 27, 2019

(87) PCT Pub. No.: WO2018/044171
PCT Pub. Date: Mar. 8, 2018

(65) Prior Publication Data

US 2019/0195509 A1 Jun. 27, 2019

(30) Foreign Application Priority Data

Sep. 2, 2016 (NL) ..... 2017410

(51) Int. Cl.
*F24C 14/00* (2006.01)
*B08B 9/00* (2006.01)

(52) U.S. Cl.
CPC ..... *F24C 14/005* (2013.01); *B08B 9/00* (2013.01)

(58) Field of Classification Search
CPC ..... F24C 14/005; B08B 9/093; B08B 9/0936
See application file for complete search history.

(56) References Cited

U.S. PATENT DOCUMENTS 3,593,728 A 7/1971 Sauer
6,478,034 B1 11/2002 Durth
(Continued)

FOREIGN PATENT DOCUMENTS

DE 19838864 A1 3/2000
DE 102006025508 A1 12/2006
(Continued)

OTHER PUBLICATIONS

Machine translation: DE102011017021, Klouda, J. (Year: 2012).*
(Continued)

*Primary Examiner* — Natasha N Campbell
(74) *Attorney, Agent, or Firm* — Rogowski Law LLC

(57) ABSTRACT

A system 1 comprises a self-cleaning rotisserie oven 2 with a casing 4, a door 6, and an oven cavity 8, for cooking a food product. The system 1 further comprises a cleaning unit 10, which is a separate unit from the self-cleaning oven 2. The cleaning unit 10 comprises a frame 12, supporting a water tank 14, and a waste water tank 16. The frame 12 of the cleaning unit 10 is movably supported by wheels 18. The cleaning unit 10 comprises a push bar 20. The self-cleaning rotisserie oven 2 comprises a discharge hose connector 22, and a water hose connector 24, for connecting a discharge hose 26, and a water hose 28 respectively, to the cleaning unit 10. The self-cleaning rotisserie oven 2 further comprises a control 30 with a user interface, and a timer. The system 1 also comprises a second self-cleaning rotisserie oven 32.

11 Claims, 4 Drawing Sheets

(56) References Cited

U.S. PATENT DOCUMENTS

| | | | | |
|---|---|---|---|---|
| 8,193,470 | B1 | 6/2012 | Harlamert | |
| 2005/0056634 | A1* | 3/2005 | Shozo | F24C 14/005 219/401 |
| 2009/0178576 | A1* | 7/2009 | Valentine | A47J 37/042 99/421 H |
| 2009/0283111 | A1* | 11/2009 | Classen | B01D 29/11 134/10 |
| 2011/0126869 | A1* | 6/2011 | Heisele | D06F 35/005 134/56 D |
| 2016/0341431 | A1 | 11/2016 | Topfer | |

FOREIGN PATENT DOCUMENTS

| | | | | |
|---|---|---|---|---|
| DE | 102007005503 | A1 | 7/2008 | |
| DE | 102011017021 | A1 | 10/2012 | |
| EP | 1209419 | A2 | 5/2002 | |
| EP | 1978309 | A1 | 10/2008 | |
| EP | 2389808 | A1 * | 11/2011 | F24C 14/005 |
| WO | 2011128103 | A2 | 10/2011 | |
| WO | 2013150330 | A1 | 10/2013 | |
| WO | 2015091803 | A1 | 6/2015 | |

OTHER PUBLICATIONS

Machine translation: EP2389808, Seeliger et al. (Year: 2011).*
Machine translation: EP1209419, Mohr et al. (Year: 2002).*
Communication issued by European Patent Office in EP 27762243.8 (dated Feb. 19, 2020).

* cited by examiner

SYSTEM COMPRISING A SELF-CLEANING OVEN, AND METHOD FOR CLEANING A SELF-CLEANING OVEN

CROSS-REFERENCE TO RELATED APPLICATIONS

This application is a national stage application (under 35 USC § 371) of PCT/NL2017/050579, filed Sep. 1, 2017, which claims benefit of Netherlands application No. 2017410, filed Sep. 2, 2016, the contents of each of which are incorporated by reference herein.

BACKGROUND OF THE INVENTION

The invention relates to a system comprising a self-cleaning oven. A system of this type is used to prepare food, such as poultry, for example chickens, in stores, bars and restaurants. Usually, the self-cleaning oven is provided with a glass door, so that potential buyers can view the cooking process of the food in an oven cavity. The cooking process typically results in grease and food particles dripping and splashing from the food, contaminating the floor and/or walls of the oven cavity. In order to ensure a regular cleaning without much human input, the self-cleaning oven is provided with a self-cleaning device. The self-cleaning device sprays water on the inside of the oven cavity at regular intervals, e.g. after a day of using the self-cleaning oven.

A system of this type is known from U.S. Pat. No. 8,375,848. This document discloses a self-cleaning rotisserie oven with a cooking chamber for cooking a food product. A rotor is used for supporting and moving a food product in the cooking chamber. The oven has hook-ups to a source of water and cleaning agent, and includes a drain path and hook-up to enable the cleaning water to be purged. A sump is positioned below the cooking chamber that collects the water provided to the cooking chamber. A sensor is positioned to detect when the sump is filled to a set level. An inlet valve is configured to control supply of water to the cooking chamber. A controller is configured to carry out a self-cleaning process.

A disadvantage of the known system is that its usage is limited in practice.

The invention aims to solve this problem, or at least to provide an alternative. In particular, the invention aims to provide a system comprising a self-cleaning oven that can be installed at low cost in more locations than the system known from U.S. Pat. No. 8,375,848.

SUMMARY OF THE INVENTION

This aim is achieved by a system comprising a self-cleaning oven, in particular a self-cleaning rotisserie oven. The self-cleaning oven comprises:

- a casing,
- an oven cavity for a food product, such as poultry, within the casing,
- a heater for heating the food product, and
- a self-cleaning device.

The self-cleaning device comprises:

- a spraying device for spraying a cleaning fluid in the oven cavity, and
- a first outlet in the lower part of the oven cavity for discharging the cleaning fluid.

The system further comprises:

- a cleaning fluid supply for supplying the cleaning fluid to the spraying device,

- a discharge, in communication with the oven cavity, for disposing of waste fluid, and
- a cleaning unit, separate from the self-cleaning oven.

The cleaning unit comprises a frame. At least one of the cleaning fluid supply and the discharge is provided in the cleaning unit.

A separate cleaning unit with a cleaning fluid supply and/or a discharge enables the self-cleaning oven to be installed at any location, where only an electrical hook-up is required. In some locations, either a water tap or a connection to the sewer might be present, in which case the cleaning unit only requires a discharge, or a cleaning fluid supply respectively. Accordingly, the cleaning unit increases the number of locations where a self-cleaning oven may be employed considerably, without the necessity of any extra plumbing. Moreover, the flexibility of use is increased, as the self-cleaning oven may be moved from one spot in a shop or restaurant to any other spot.

Within the context of this invention, the food in the oven may be heated by means of hot air, with or without forced air circulation, dry or wet steam, micro waves, and/or by means of direct heat radiation. An oven of the latter type may be called a grill in practice. The cleaning fluid is preferably water with a detergent, but may be any other fluid that is suitable for cleaning an oven as well.

Preferred embodiments are defined in the dependent claims.

In an embodiment, the self-cleaning oven is a self-cleaning rotisserie oven, comprising:

- a rotor, rotatable connected to the casing, for moving the food product in the oven cavity, and
- a drive for driving the rotor.

In an embodiment, the cleaning fluid supply is a cleaning fluid tank.

In an embodiment, the discharge is a waste fluid tank. A tank for the cleaning fluid and/or a tank for the waste fluid is a practical embodiment of a cleaning fluid supply, or discharge respectively.

In an embodiment, both the cleaning fluid supply and the discharge are provided in the cleaning unit. This makes the self-cleaning oven completely independent of the presence of plumbing.

In an embodiment, the cleaning unit comprises displacement means, in particular wheels, for movably supporting the frame. This makes it more easily to move the cleaning unit from a location with a water tap and/or a sewer to the self-cleaning oven.

In an embodiment, the spraying device comprises a first spray arm. A spray arm is an effective device to spray a large area of the oven cavity. In particular, the spray arm comprises multiple nozzles for spraying the cleaning fluid.

In particular the spraying device comprises a second spray arm. Preferably, the second spray arm is mounted opposite of the first spray arm. Preferably, the first spray arm and the second spray arm are mounted on opposing side walls of the oven cavity. A second spray arm increases the efficiency of the cleaning process.

In particular, the spraying device comprises a three-way valve assembly for directing cleaning fluid to the first or the second spray arm. An embodiment of a three-way valve assembly is two single valves, connected via a tee at the fluid supply side. Another embodiment of a three-way valve assembly is three-way valve. The three-way valve assembly enables the first and second spray arm to be used alternatively. Accordingly, less fluid flow is required in order to have enough pressure for effective cleaning. Moreover, the fluid flow within the oven cavity is more effective when only one spray arm operates at a time.

In an embodiment, the self-cleaning oven comprises a control for controlling at least the self-cleaning device, in particular the control comprises a timer for timing the intake of cleaning fluid from the cleaning fluid supply. In particular, the control controls the operation of the oven as well. A timer is a simple and effective means for controlling the amount of cleaning fluid intake.

In an embodiment, the system comprises a fluid pump, in communication with the spraying device, for moving cleaning fluid to the spraying device, in particular the fluid pump is further in communication with the cleaning fluid supply and/or with the first outlet. A fluid pump enables the intake of cleaning fluid at low pressure, e.g. fluid from a fluid tank instead of from a pressurised water duct, and/or the recirculation of cleaning fluid from the oven cavity.

The invention further relates to a system, comprising a self-cleaning oven, in particular a self-cleaning rotisserie oven, wherein the self-cleaning device comprises a pressure regulator, the pressure regulator being provided behind the cleaning fluid supply in fluid flow direction. Thanks to the pressure regulator, such as a pressure valve, the flow rate of cleaning fluid behind the pressure regulator is known, regardless of the fluid pressure in the cleaning fluid supply. This enables a simple control of the cleaning fluid intake, preferably by means of a timer, more preferably by means of an automatic timer.

A system comprises a self-cleaning oven, in particular a self-cleaning rotisserie oven, wherein the self-cleaning oven comprises a first detergent holder and a second detergent holder, the second detergent holder being provided at a higher level than the first detergent holder. In particular the first detergent holder and the second detergent holder are provided in the oven cavity. This arrangement is advantageous for providing a double cleaning cycle. During the first cycle, cleaning fluid is entered into the oven cavity, until the level exceeds the level of the first detergent, but stays below the level of the second detergent. The first detergent, solid of liquid, dissolves in the cleaning fluid, so that the first cleaning cycle is performed with the cleaning fluid and the first detergent. After the first cleaning cycle, the fluid is removed, and new cleaning fluid enters the oven cavity to a level exceeding the level of the second detergent. The second cleaning cycle is then performed with the cleaning fluid and the second detergent. This inventive arrangement obviates opening of the oven cavity after the first cleaning cycle, in order to reintroduce the second detergent, or providing a controlled mechanism that releases the second detergent only after the first cleaning cycle.

Providing the first detergent holder and the second detergent holder in the oven cavity results in a simple construction and ease of use. In an alternative, the first detergent holder and the second detergent holder are provided in a separate unit, such as a buffer tank, wherein the cleaning fluid is introduced before it enters the oven cavity.

The invention further relates to a system, comprising a self-cleaning oven, in particular a self-cleaning rotisserie oven, further comprising at least one washing tablet. Known self-cleaning ovens use liquid detergents for cleaning the oven. A disadvantage of these liquid detergents is that these are aggressive and may be harmful for the operator who supplies the liquid detergent to the self-cleaning oven. The inventive washing tablet avoids harmful interaction with the body of the operator. Moreover, it has the advantage that it is easy to apply the proper dose.

In particular, the washing tablet is suitable for cleaning poultry grease from the self-cleaning oven. Poultry grease requires relative strong detergent components.

In particular, the washing tablet is provided with an envelope, in particular a water soluble envelope, such as a water soluble foil or water soluble coating. The envelope protects the user from direct contact with the detergent components of the washing tablet, and/or enables the use of liquid detergent components inside the washing tablet.

In an embodiment the first detergent holder and/or the second detergent holder of the self-cleaning oven are suitable for the at least one washing tablet.

The invention further relates to a method for cleaning a self-cleaning oven, in particular a self-cleaning rotisserie oven, the self-cleaning oven comprising a self-cleaning device, the method comprising the steps:

providing a cleaning unit, the cleaning unit comprising at least one of a cleaning fluid supply and a discharge, hooking up the cleaning unit to the self-cleaning device of the self-cleaning oven, providing cleaning fluid, cleaning of the self-cleaning oven, discharging waste fluid, wherein the cleaning fluid is provided from the cleaning fluid supply of the cleaning unit, and/or the waste fluid is discharged to the discharge of the cleaning unit.

This method provides the advantages as described above in relation to the system. Thanks to the cleaning unit, the self-cleaning oven is usable at more locations and can be used more flexible than known self-cleaning ovens.

The invention further relates to a method for cleaning an oven cavity of a self-cleaning oven, in particular a self-cleaning rotisserie oven, the self-cleaning oven comprising a self-cleaning device, the method comprising the steps:

providing a first portion of detergent at a first height level and providing a second portion of detergent at a second height level, above the first height level, filling the oven cavity with a first amount of cleaning fluid to at least the first height level and below the second height level, cleaning the oven cavity with the first amount of cleaning fluid and the first portion of detergent, discharging the first amount of cleaning fluid and the first portion of detergent from the oven cavity, filling the oven cavity with a second amount of cleaning fluid to at least the second height level, cleaning the oven cavity with the second amount of cleaning fluid and the second portion of detergent, and discharging the second amount of cleaning fluid and the second portion of detergent from the oven cavity.

This method provides the advantages as described above in relation to the system. Thanks to providing first and second portions of detergent at different levels, the release of the detergent is controlled by the amount of cleaning fluid that is allowed into the oven cavity. This is much more simple than known methods of providing two portions of detergent for two subsequent cleaning cycles.

In particular, the first portion of detergent is a washing tablet and/or the second portion of detergent is a washing tablet.

In particular, the method is continued with the steps of: filling the oven cavity with a third amount of cleaning fluid, and rinsing the oven cavity with the third amount of cleaning fluid.

This cleans the ducts and spraying device from remaining detergent and dirt.

In particular, the method is continued with the step of: reversing the flow direction of the cleaning fluid, in particular the third amount of cleaning fluid, in order to clean a filter. In particular the filter is positioned at an outlet of the oven cavity.

The invention further relates to a method for cleaning a self-cleaning oven, in particular a self-cleaning rotisserie oven, the self-cleaning oven comprising a self-cleaning device, as well as a valve and a pressure regulator between a cleaning fluid supply and the self-cleaning device, the method comprising the steps:

providing cleaning fluid by opening the valve for a predetermined amount of time, cleaning of the self-cleaning oven by means of the self-cleaning device, and discharging of the waste fluid.

This method provides the advantages as described above in relation to the system, in that no level sensor is required.

DESCRIPTION OF THE DRAWINGS

The invention, its effects, and advantages will be explained in more detail on the basis of the schematic drawings, in which.

DETAILED DESCRIPTION

Figure 1:
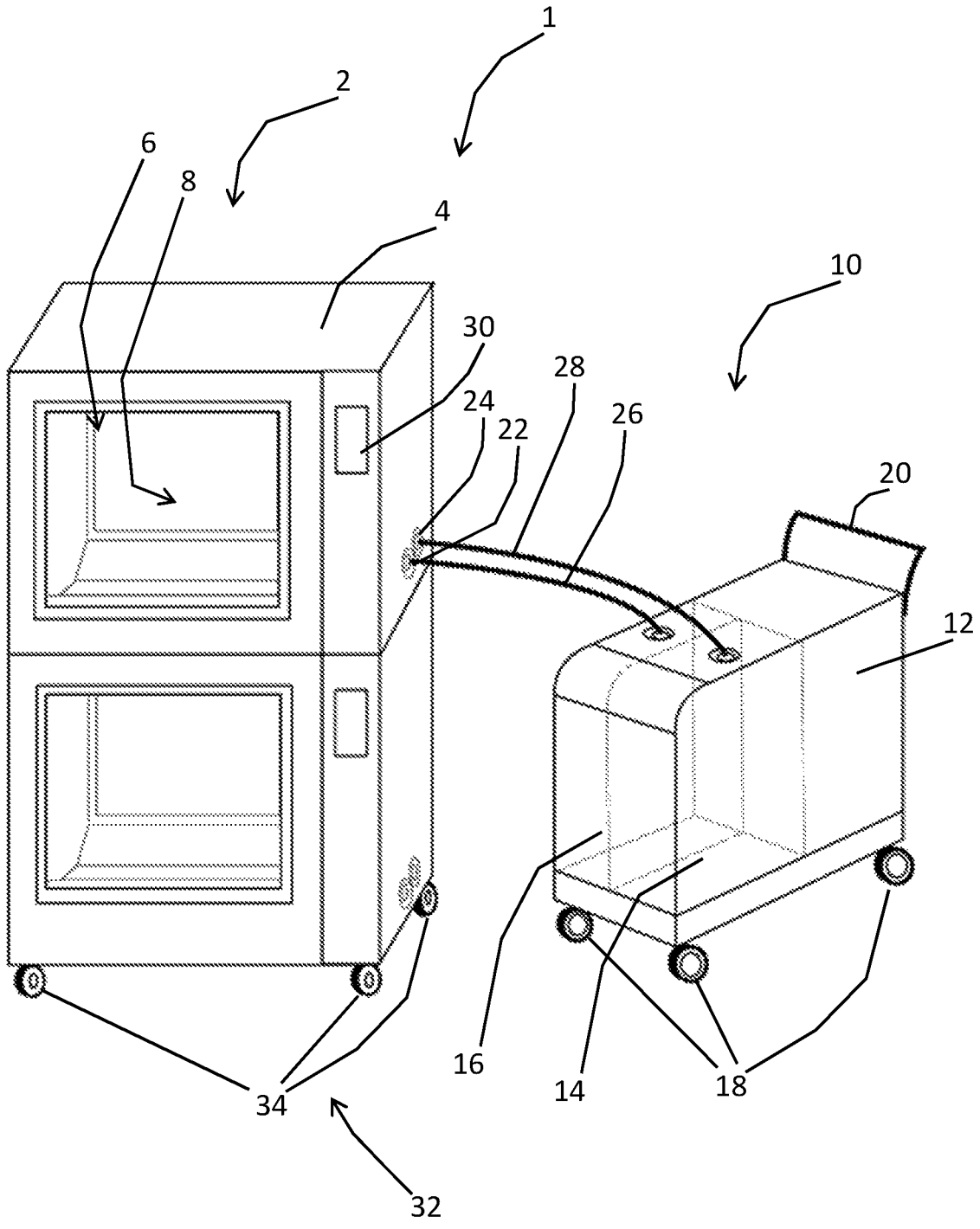
FIG. 1 shows a perspective view of a system according to the invention.

The figures show a system according to the invention, which is denoted in its entirety by reference number 1. The system 1 comprises a self-cleaning oven, in this embodiment a self-cleaning rotisserie oven 2. The self-cleaning rotisserie oven 2 comprises a casing 4, a door 6, and a cooking chamber, or oven cavity 8, within the casing 4, for cooking a food product, such as a chicken. The casing 4 of this embodiment is made of metal, preferably steel. The door 6 of this embodiment is made of glass, in a steel frame.

The system 1 further comprises a cleaning unit 10, which is a separate unit from the self-cleaning oven 2. The cleaning unit 10 comprises a frame 12, supporting a cleaning fluid supply, in this case a water tank 14, and a discharge, in this case a waste water tank 16. The frame 12 of the cleaning unit 10 is movably supported by displacement means, in this embodiment wheels 18, in particular castor wheels. The frame 12, the water tank 14, and the waste water tank 16 of the cleaning unit 10 of this embodiment are made of steel. The cleaning unit 10 further comprises a push bar 20 at an upper side of the frame 12. Accordingly, the cleaning unit 10 is movable on the wheels 18 to and from the self-cleaning rotisserie oven 2 by pushing or pulling the push bar 20.

The self-cleaning rotisserie oven 2 further comprises a discharge hose connector 22, and a water hose connector 24, for connecting a discharge hose 26, and a water hose 28 respectively, to the cleaning unit 10. The self-cleaning rotisserie oven 2 further comprises a control 30 with a user interface, a control logic, and a timer (not shown).

The system 1 of this embodiment further comprises a second self-cleaning rotisserie oven 32, which is substantially the same or similar to the self-cleaning rotisserie oven 2, and is not described here in detail. The second self-cleaning rotisserie oven 32 is positioned below and connected to the self-cleaning rotisserie oven 2. It comprises a similar cleaning device as the self-cleaning rotisserie oven 2, and can be hooked up to the same cleaning unit 10. The self-cleaning rotisserie oven 2 and the second self-cleaning rotisserie oven 32 are in this embodiment jointly movably supported by displacement means, in this case wheels 34.

Figure 2:
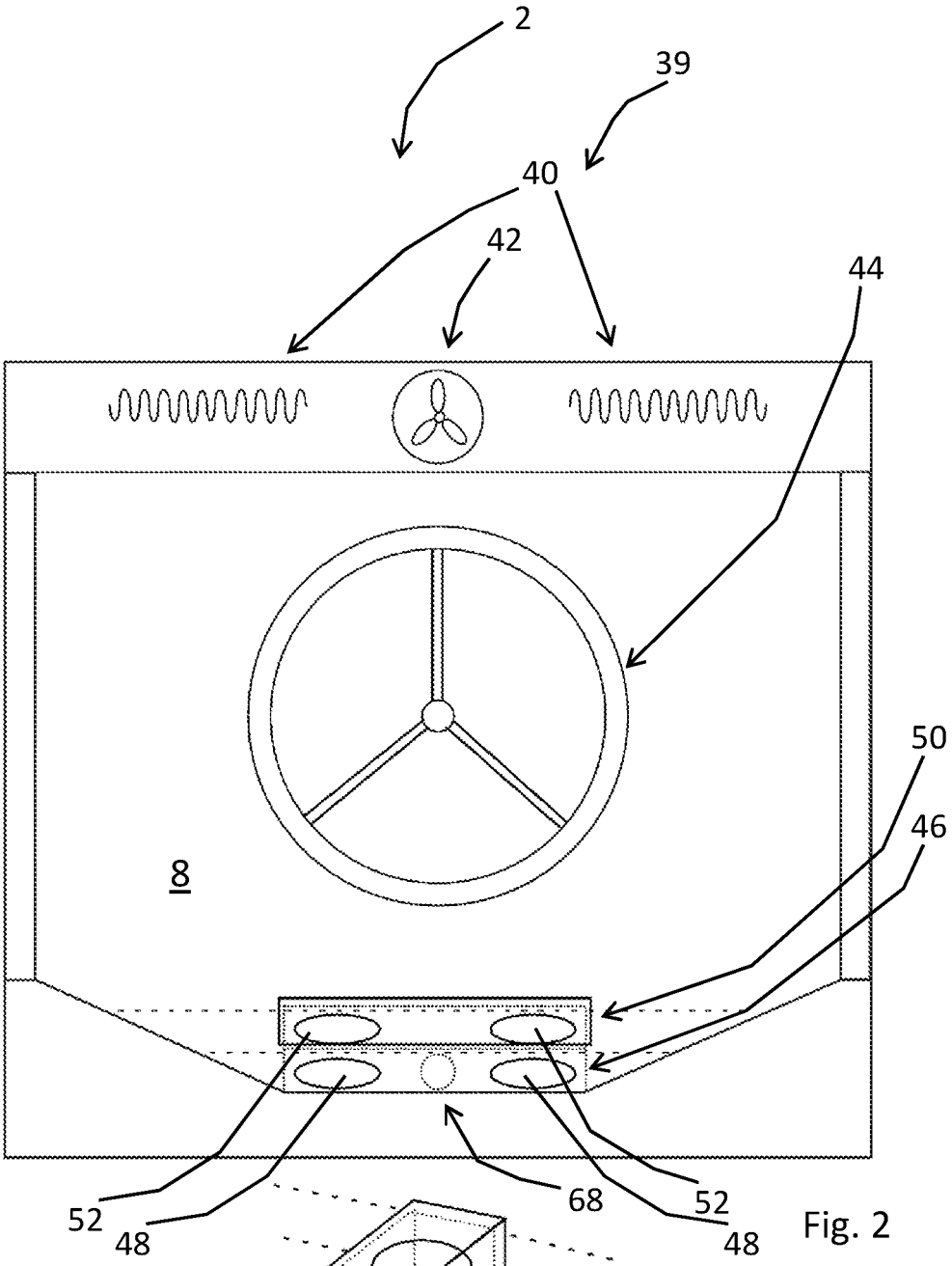
FIG. 2 shows a cross section through a self-cleaning rotisserie oven of the system of FIG. 1.

Referring now to FIG. 2, the self-cleaning rotisserie oven 2 comprises a heater 39 for heating the food product. The heater 39 of this embodiment comprises two heating elements 40, e.g. electrical heating spirals or plates, and a ventilator 42. Moreover, a guiding structure (not shown), is provided in a known manner in order to direct a hot air stream to the food product. The self-cleaning rotisserie oven 2 further comprises a rotor 44, rotatable connected to the casing 4, for moving the food product in the oven cavity 8. In this embodiment, the self-cleaning rotisserie oven 2 comprises two identical rotors 44 opposite of each other (only one shown in FIGS. 2 and 5), a joint axis connecting both rotors 44, an electrical drive (not shown) for driving the rotor 44, and at least one product support. In this embodiment, there are several exchangeable food supports which are connectable to the rotary main support for supporting the food product. An example of a food support is a spit, preferably used to hold a chicken. Another example is a basket for holding other type of food products.

The self-cleaning oven 2 further comprises a first detergent holder 46 for a first detergent, in this embodiment washing tablets 48, and a second detergent holder 50 for a second detergent, in this embodiment washing tablets 52. The second detergent holder 50 is provided at a higher level than the first detergent holder 46. In this embodiment, the first detergent holder 46 and the second detergent holder 50 are provided in the oven cavity 8. In this embodiment, the first detergent holder 46 is merely a space on the floor of the oven cavity 8 below the second detergent holder 50. The washing tablets 48, 52 comprise different types of detergents with specific properties and are provided with a water soluble foil which protects the user from direct contact with the detergents.

Figure 4:
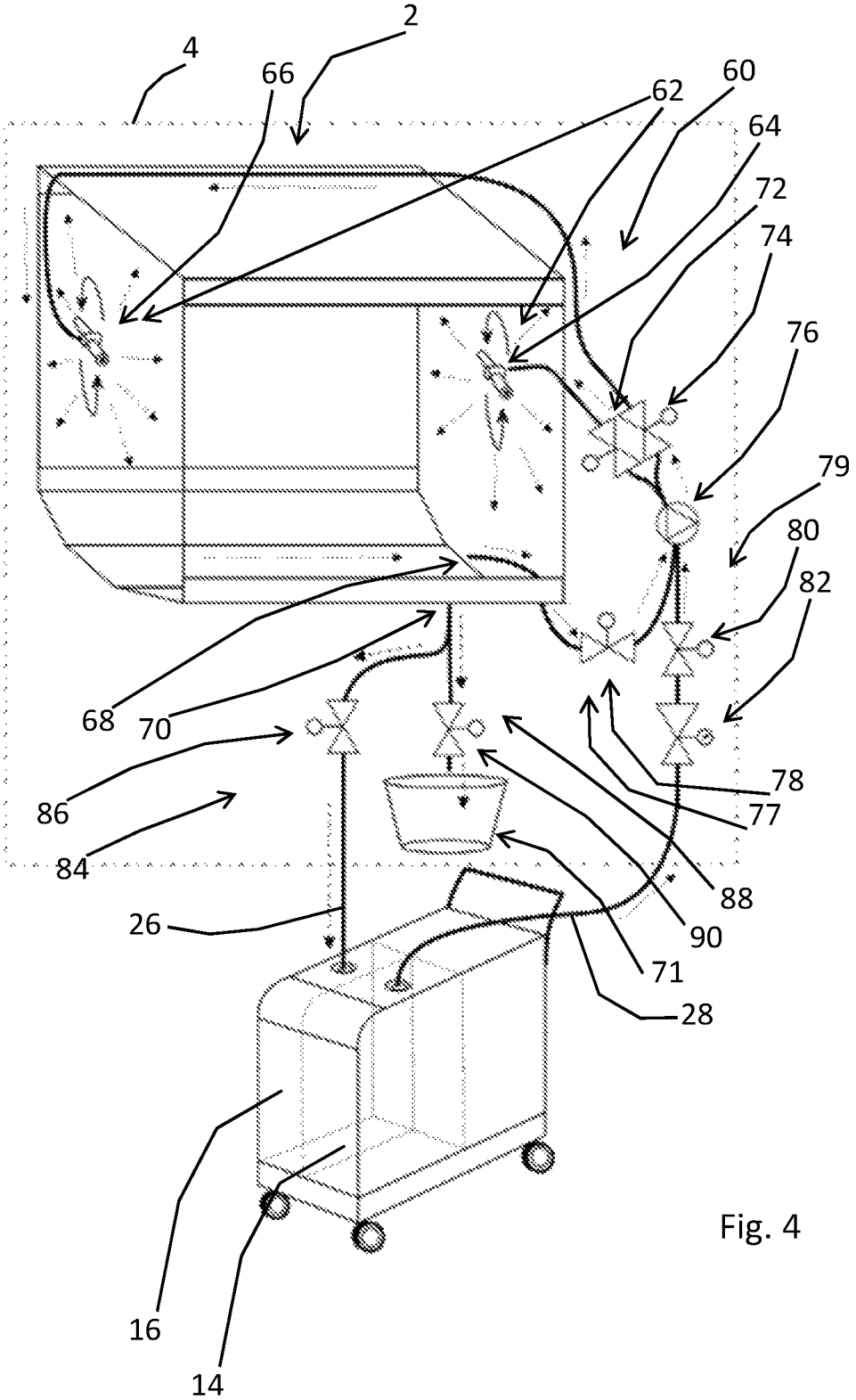
FIG. 4 schematically shows components of the system of FIG. 1.

Referring to FIG. 4, the self-cleaning oven 2 comprises a self-cleaning device 60, with a spraying device 62 for spraying water in the oven cavity 8. The spraying device 62 of this embodiment comprises a first spray arm 64, and a second spray arm 66, opposite of the first spray arm 64. Both the first 64, and second 66 spray arm are rotatably connected to an inner wall of the oven cavity 8. The self-cleaning device 60 of this embodiment further comprises a first outlet 68 (also shown in FIG. 2), and a second outlet 70. The first outlet 68 and the second outlet 70 are both provided in a lower part of the oven cavity 8 for discharging water. The first outlet 68 is provided with a filter (not shown). The second outlet 70 is designed to discharge grease and food particles to a waste container 71. The spraying device 62 of this embodiment further comprises a three-way valve assembly, in this embodiment consisting of a two remotely controlled ball valves 72, 74 for directing water to the first or the second spray arm 64, 66.

The system 1 further comprises a fluid, or water pump 76. The water pump 76 is in communication with the spraying device 62 at its pressure side, for moving water to the spraying device 62. In this embodiment, the water pump 76 is at its suction side in communication with the first outlet 68 via two pipe sections 77 and a remotely controllable ball valve 78. In this embodiment, the water pump 76 is further in communication with the water supply 14 via three pipes sections 79, a remotely controllable ball valve 80, a pressure regulator 82, and the water hose 28. Accordingly, the water pump 76 is configured to supply water to the spraying device 62 from either the water supply 14 or the bottom of the oven cavity 8, depending on the positions of the remotely controllable ball valves 78 and 80.

The oven cavity 8 of this embodiment is in communication with the discharge 16 via second outlet 70, two internal pipe sections 84, a remotely controllable ball valve 86, and the discharge hose 26 for disposing of waste water that assembles in the lower port of the oven cavity 8 during cleaning. The oven cavity 8 of this embodiment is further in communication with the waste container 71 via the same second outlet 70, two internal pipe sections 88, and a remotely controllable ball valve 90. During cooking of a food product, grease is discharged to the waste container 71 by opening the remotely controllable ball valve 90, while the remotely controllable ball valve 86 is closed. During a cleaning operation, in particular at the end of a cleaning cycle, waste water coming out of the oven cavity 8 is discharged to the discharge 16 by opening the remotely controllable ball valve 86, while the remotely controllable ball valve 90 is closed.

The control 30 in this embodiment controls both the cooking operation of the self-cleaning rotisserie oven 2, and that of the self-cleaning device 60. The control is operatively connected to the remotely controllable ball valves 72, 74, 78, 80, 86, and 90, to the pressure regulator 82, to the water pump 76, to the heating elements 40, and to the ventilator 42. The timer of the control 30 is configured to time the intake of water from the water supply 14, by opening and closing the remotely controllable ball valve 80. Moreover, the control 30 is programmed to set the pressure regulator 82 such, that a predetermined flow rate of water flows out of it. In this way, the control 30, including its timer, and the pressure regulator 82 determine the amount of water that is taken into the oven cavity 8 for cleaning the oven cavity 8, without the need for a water level sensor.

Figure 3:
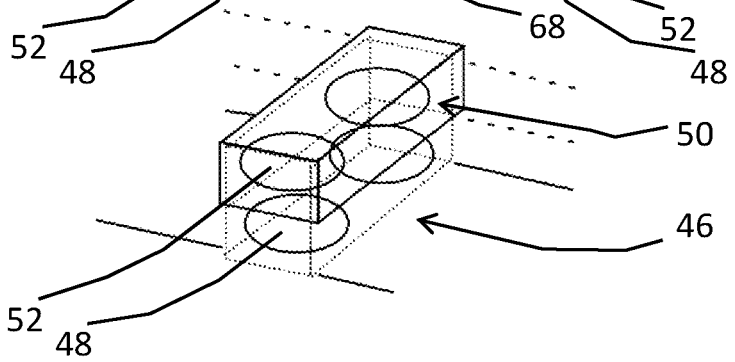
FIG. 3 shows a detail of FIG. 2 in a perspective view.
Figure 5:
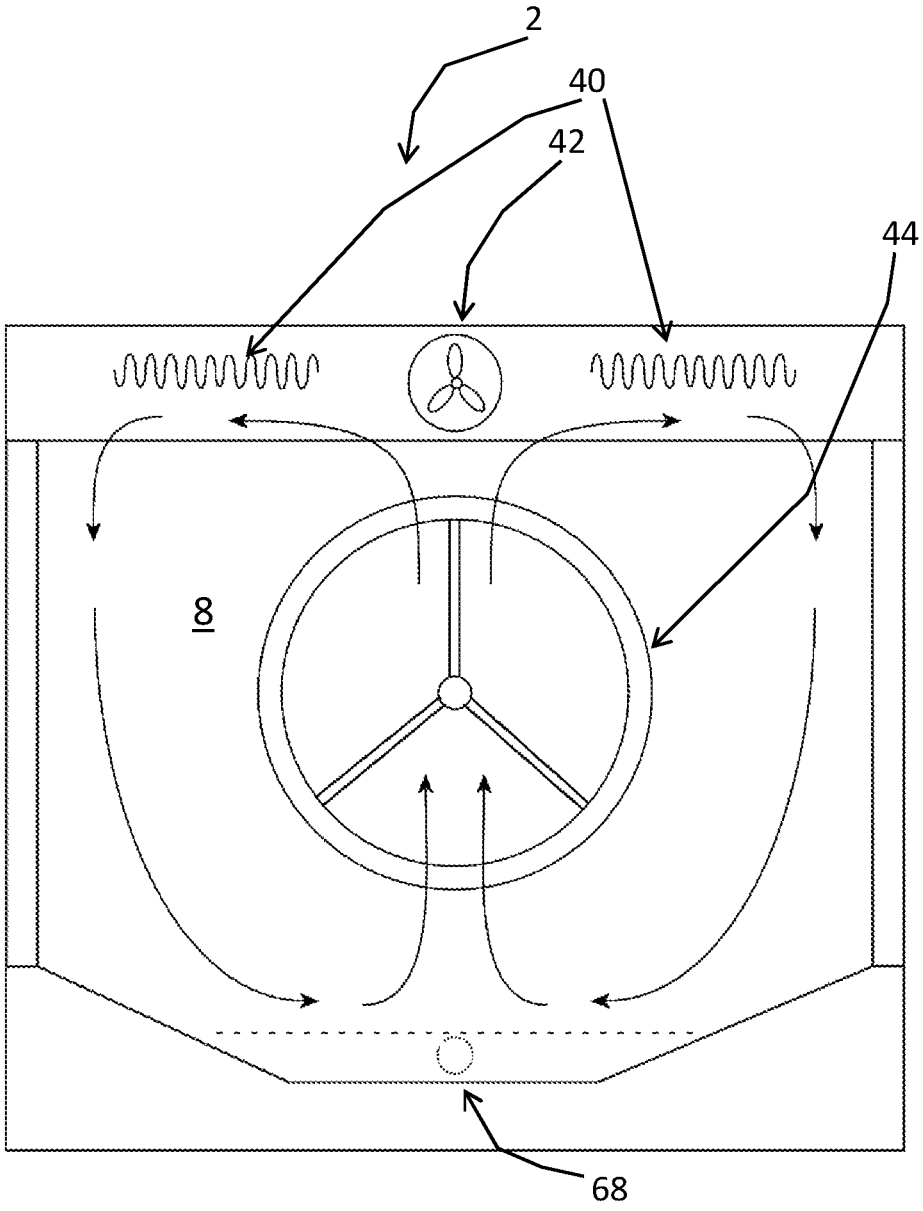
FIG. 5 schematically shows the self-cleaning rotisserie oven in the cross section view of FIG. 2 during cleaning.

FIG. 5 schematically shows the self-cleaning rotisserie oven 2 during a cleaning cycle. Before the cleaning starts, the self-cleaning rotisserie oven 2 is let to cool partly or completely. After that, the washing tablets 48 and 52 (see FIG. 3) are placed, and cleaning fluid, such as water is sprayed by the spray arms. The arrows in FIG. 5 schematically indicate the flow of the water. The two upwards pointing arrows indicate that the water is sucked from the oven cavity 8 via first outlet 68 to a spraying device (not shown in FIG. 5). From the spraying device, the cleaning fluid at least partly goes upwards, where it is heated by heating elements 40. It is noted that ventilator 42 is not operating during the cleaning cycle. The cleaning water flows back via the walls of the oven cavity 8 to the first outlet 68. Here, the washing tablets 48 and/or 52 are dissolved in the water (see below).

During use, an inventive method for cleaning a self-cleaning oven, such as self-cleaning rotisserie oven 2, is performed. The method comprises the steps:

- providing a cleaning unit, such as the cleaning unit 10,
- hooking up the cleaning unit to a self-cleaning device of the self-cleaning rotisserie oven,
- providing of a cleaning fluid, such as water, preferably from a water tank of the cleaning unit,
- cleaning of the self-cleaning rotisserie oven by means of the self-cleaning device,
- discharging of the waste water, preferably to a waste water tank of the cleaning unit.

Preferably, the cleaning is performed by alternately providing water to a first and second cleaning arm of the self-cleaning device.

Preferably, the providing of water is performed by opening a valve for a predetermined amount of time.

Preferably, the steps of providing water, cleaning, and discharging of waste water, are repeated once or twice. More preferably, the last repetition is done with water without a detergent.

During use, an inventive method for cleaning an oven cavity of a self-cleaning oven, such as self-cleaning rotisserie oven 2, is performed. The method comprises the steps;

- providing a first portion of detergent at a first height level and providing a second portion of detergent at a second height level, above the first height level,
- filling the oven cavity with a first amount of water to at least the first height level and below the second height level,
- cleaning the oven cavity with the first amount of water and the first portion of detergent,
- discharging the first amount of water and the first portion of detergent from the oven cavity,
- filling the oven cavity with a second amount of water to at least the second height level,
- cleaning the oven cavity with the second amount of water and the second portion of detergent,
- discharging the second amount of water and the second portion of detergent from the oven cavity.

Preferably, the cleaning is performed by alternately providing water to a first and second cleaning arm of the self-cleaning device.

Preferably, the providing of water is performed by opening a valve fora predetermined amount of time.

Preferably, the oven cavity is filled with water for a third time, without a detergent being present anymore. More preferably, a flow direction of water is reversed in order to clean a filter.

Several variants are possible within the scope of the attached claims. The features of the above described preferred embodiment may be replaced by any other feature within the scope of the attached claims, such as the features described in the following paragraphs.

In an embodiment, the cleaning unit has a cleaning fluid hose, preferably on a reel, and/or a discharge hose, preferably on a reel, as cleaning fluid supply, or discharge respectively. In an embodiment, the fluid pump is provided in the cleaning unit. In an embodiment, the control for the cleaning device is provided in the cleaning unit. In an embodiment, the water supply is provided and the discharge is not provided in the cleaning unit. In an embodiment, the water supply is not provided and the discharge is provided in the cleaning unit. In an embodiment, the cleaning fluid supply and/or the discharge are supported by the frame of the cleaning unit.

In an embodiment, the self-cleaning oven is of another type than a self-cleaning rotisserie oven, such as a combi steamer. In an embodiment, the system comprises more than two self-cleaning ovens. In an alternative, the system comprises one self-cleaning oven. In an embodiment, the casing is made of a transparent material, such as glass. In an embodiment, the heater is a direct radiation heater for grilling a food product with direct heat radiation. In particular, no ventilator is present. In an embodiment, the self-cleaning oven comprises a steam supply. In an embodiment, the self-cleaning oven does not have a rotor with associated drive. In an embodiment, only one rotor is present. In an embodiment, one or more food supports are integrated with the rotor. In an embodiment, the drive for the rotor is an electrical direct drive motor. In an alternative embodiment, the drive comprises a motor and gear and/or belts.

In an embodiment, the spraying device comprises one spray arm only. In an alternative embodiment, the spraying device comprises more than two spray arms. In an embodiment, the spraying device comprises a stationary nozzle, in particular multiple stationary nozzles. In an embodiment, there is one joint outlet from the oven cavity for discharging of grease, for recirculation of cleaning fluid, and for discharge of waste fluid.

In an embodiment, the cleaning unit and/or the self-cleaning oven are not provided with wheels. In an embodiment, some or all of the valves are manually operated. It should be noted that a system comprising a self-cleaning oven with a pressure regulator is considered inventive in itself, with or without a separate cleaning unit. Moreover, a system comprising a self-cleaning oven with a first and second detergent holder at different height levels is considered inventive in itself, with or without a separate cleaning unit.

The present invention is not restricted in terms of its configuration to the embodiments presented here. Rather, several variants are conceivable which make use of the solution presented here, even in the case of other types of configurations. It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A system comprising a self-cleaning rotisserie oven, the self-cleaning rotisserie oven comprising:

a casing, an oven cavity within the casing for receiving a food product, a heater for heating the food product, and a self-cleaning device, the self-cleaning device comprising:

a spraying device for spraying a cleaning fluid in the oven cavity, wherein the spraying device comprises a first spray arm, and a second spray arm, and the first spray arm and the second spray arm are mounted for rotation to opposing inner walls of the oven cavity, and wherein the spraying device comprises a three-way valve assembly for directing cleaning fluid alternately to the first spray arm and the second spray arm, a first outlet in a lower part of the oven cavity for discharging cleaning fluid, the system further comprising:

a cleaning fluid supply for supplying the cleaning fluid to the spraying device, and a discharge in communication with the oven cavity configured for disposing of waste fluid.

2. The system according to claim 1, further comprising a cleaning unit, separate from the self-cleaning rotisserie oven, the cleaning unit comprising a frame, wherein at least one of the cleaning fluid supply and the discharge is provided in the cleaning unit.

3. The system according to claim 2, wherein the cleaning fluid supply is a cleaning fluid tank, the discharge is a waste fluid tank, and both the cleaning fluid tank and the waste fluid tank are provided in the cleaning unit.

4. The system according to claim 3, wherein the cleaning unit comprises displacement means for movably supporting the frame.

5. The system according to claim 1, wherein the self-cleaning rotisserie oven comprises a control for controlling at least the self-cleaning device.

6. The system according to claim 5, wherein the control comprises a timer for timing the intake of cleaning fluid from the cleaning fluid supply.

7. The system according to claim 1, further comprising a fluid pump, in communication with the spraying device, for moving cleaning fluid to the spraying device.

8. The system according to claim 1, wherein the self-cleaning device comprises a pressure regulator, the pressure regulator being provided behind the cleaning fluid supply in cleaning fluid flow direction for regulating the flow rate of cleaning fluid.

9. The system according to claim 1, wherein the self-cleaning rotisserie oven comprises a first detergent holder and a second detergent holder, the second detergent holder being provided at a higher level than the first detergent holder.

10. The system according to claim 9, wherein the first detergent holder and the second detergent holder are provided in the oven cavity.

11. The system according to claim 9 further comprising at least one washing tablet suitable for cleaning poultry grease from the self-cleaning rotisserie oven.

* * * * *